US010253487B2

(12) United States Patent
Morotomi et al.

(10) Patent No.: US 10,253,487 B2
(45) **Date of Patent: *Apr. 9, 2019**

(54) SANITARY WASHING APPARATUS

(71) Applicant: TOTO LTD., Kitakyushu-shi, Fukuoka (JP)

(72) Inventors: Yo Morotomi, Fukuoka-ken (JP); Koichiro Matsushita, Fukuoka-ken (JP); Satoru Matsumoto, Fukuoka-ken (JP); Katsunori Ishii, Fukuoka-ken (JP); Yukiko Yano, Fukuoka-ken (JP)

(73) Assignee: TOTO LTD., Fukuoka (JP)

( * ) Notice: Subject to any disclaimer, the term of this patent is extended or adjusted under 35 U.S.C. 154(b) by 137 days.

This patent is subject to a terminal disclaimer.

(21) Appl. No.: 15/083,480

(22) Filed: Mar. 29, 2016

(65) Prior Publication Data

US 2016/0208473 A1 Jul. 21, 2016

Related U.S. Application Data

(63) Continuation of application No. 13/162,681, filed on Jun. 17, 2011, now Pat. No. 9,328,497.

(30) Foreign Application Priority Data

Jun. 18, 2010 (JP) ..... 2010-139863

(51) Int. Cl.
*E03D 9/08* (2006.01)

(52) U.S. Cl.
CPC ..... *E03D 9/08* (2013.01)

(58) Field of Classification Search
CPC ..... E03D 9/08; E03D 9/085; A47K 7/08
USPC ..... 4/420.2, 443
See application file for complete search history.

(56) References Cited

U.S. PATENT DOCUMENTS

| | | | |
|---|---|---|---|
| 5,970,528 | A | 10/1999 | Shirai |
| 2005/0246828 | A1 | 11/2005 | Shirai |
| 2007/0256225 | A1 | 11/2007 | Kim |
| 2011/0041243 | A1 | 2/2011 | Kwon |

FOREIGN PATENT DOCUMENTS

| | | | |
|---|---|---|---|
| JP | 08-093034 | A | 4/1996 |
| JP | 10-034156 | A | 2/1998 |
| JP | 10-266307 | A | 10/1998 |

(Continued)

OTHER PUBLICATIONS

Japanese Office action for 2010-139863 dated Mar. 17, 2011.

*Primary Examiner* — Christine Skubinna
(74) *Attorney, Agent, or Firm* — Pearne & Gordon LLP

(57) ABSTRACT

According to one embodiment, a sanitary washing apparatus includes: a nozzle including a jetting port and configured to squirt water from the jetting port to wash a user's body; a flow channel configured to guide water supplied from a water supply source to the jetting port; an electrolytic cell provided midway along the flow channel and being operable to produce sterilizing water; a heating device provided on the flow channel on upstream side of the electrolytic cell; a nozzle cleaning device configured to clean or sterilize the nozzle with the water heated by the heating device or the sterilizing water produced by the electrolytic cell; and a controller configured to perform control for stopping energization of the heating device or reducing an amount of energization of the heating device when energizing the electrolytic cell.

28 Claims, 8 Drawing Sheets

(56) References Cited

FOREIGN PATENT DOCUMENTS

| | | | |
|---|---|---|---|
| JP | 2001-279745 | A | 10/2001 |
| JP | 3487447 | B2 | 10/2003 |
| JP | 2005-155098 | A | 6/2005 |
| JP | 2007-332537 | A | 12/2007 |
| KR | 10-1146419 | B1 | 5/2012 |

| COMPOUND | θ /℃ / UNIT | 0 | 10 | 20 | 25 | 30 | 40 | 50 | 60 | 80 | 100 |
|---|---|---|---|---|---|---|---|---|---|---|---|
| $CaCO_3$ | g/L | 1.34 | 1.11 | 0.91 | 0.82 | 0.72 | 0.55 | 0.43 | 0.36 | 0.26 | 0.20 |

FIG. 8

SANITARY WASHING APPARATUS

CROSS-REFERENCE TO RELATED APPLICATIONS

This application is based upon and claims the benefit of priority from the prior Japanese Patent Application No. 2010-139863, filed on Jun. 18, 2010; the entire contents of which are incorporated herein by reference.

BACKGROUND OF THE INVENTION

Field of the Invention

An aspect of the invention relates generally to a sanitary washing apparatus, specifically relates to a sanitary washing apparatus for washing such as a "bottom" of a user seated on a sit-down toilet stool with water.

Background Art

When a washing nozzle for washing the body, such as the "bottom", of a user seated on a toilet seat squirts wash water at the body, at least part of the washing nozzle is exposed (advanced) outside from the casing installed with prescribed functional components including the washing nozzle and a hot water tank. Hence, dirt and dirty water may be attached to the washing nozzle. In this context, there is a sanitary washing apparatus which cleans away dirt and dirty water attached to the washing nozzle before and/or after body washing. This keeps the washing nozzle clean.

However, in a humid environment such as a toilet room, even after dirt and dirty water attached to the washing nozzle are cleaned away, bacteria may grow on the washing nozzle over time. More specifically, bacteria such as methylobacteria, called pink slime, and black mold grow on the bowl surface of the toilet stool. Such bacteria may be attached to the washing nozzle and multiplied thereon. Multiplication of bacteria results in an aggregation of bacteria and their secretion (slime, black stain), called biofilm, for instance. The biofilm is difficult to remove by the normal nozzle cleaning as mentioned above.

In this context, Japanese Patent No. 3487447 discloses a private part washing apparatus in which an electrolytic cell is incorporated as a nozzle cleaning water producing part. In the private part washing apparatus described in Japanese Patent No. 3487447, when tap water is used as cleaning water, chlorine contained therein is electrolyzed and chemically changed to hypochlorous acid. This can serve as an acidic chemical for cleaning. Hence, effective cleaning can be performed on dirt such as resulting from ammonia in particular.

Here, to efficiently use the cleaning water produced in the electrolytic cell, it is more preferable that the electrolytic cell be provided closer to the nozzle. Thus, JP-A-2005-155098 discloses a private part washing apparatus in which an electrolytic cell is provided on the flow channel on the downstream side of the hot water tank. In the private part washing apparatus described in JP-A-2005-155098, hot water in the electrolytic cell is electrolyzed into electrolytic water. The nozzle cleaning means squirts the hot water as cleaning water at the bottom washing nozzle and the bidet washing nozzle.

However, electrolysis of hot water into electrolytic water is likely to result in producing e.g. calcium carbonate, known as "scale". Scale attached to the electrode of the electrolytic cell causes the problem of decreased production capacity of electrolytic water.

In this context, in order to remove scale, the private part washing apparatus described in JP-A-2005-155098 inverts the polarity of voltage applied to the electrode. Likewise, JP-A-10-034156 discloses an electrolytic cell control apparatus including a polarity switching means for switching the polarity of the anode side and the cathode side of the electrodes of the electrolytic cell. In the private part washing apparatus and the electrolytic cell control apparatus described in JP-A-2005-155098 and JP-A-10-034156, respectively, the produced scale is detached from the surface of the electrode by polarity inversion.

However, if a large amount of scale is produced before performing polarity inversion, in a sanitary washing apparatus with a relatively narrow flow channel, the flow channel may be clogged with scale detached from the electrode. Furthermore, after private part washing, even if heating means such as a hot water tank is not in operation, the flow channel and the electrolytic cell are filled with hot water for the private part washing. Thus, scale is produced even after private part washing, and the amount of the scale may become larger. On the other hand, if polarity inversion is performed frequently, the problem is that the electrode of the electrolytic cell is degraded earlier, and the lifetime of the electrode becomes shorter.

SUMMARY OF THE INVENTION

According to an aspect of the invention, there is provided a sanitary washing apparatus including: a nozzle including a jetting port and configured to squirt water from the jetting port to wash a user's body; a flow channel configured to guide water supplied from a water supply source to the jetting port; an electrolytic cell provided midway along the flow channel and being operable to produce sterilizing water; a heating device provided on the flow channel on upstream side of the electrolytic cell; a nozzle cleaning device configured to clean or sterilize the nozzle with the water heated by the heating device or the sterilizing water produced by the electrolytic cell; and a controller configured to perform control for stopping energization of the heating device or reducing an amount of energization of the heating device when energizing the electrolytic cell.

BRIEF DESCRIPTION OF THE DRAWINGS

FIG. 8 is a view showing the variation of the amount of dissolution of calcium carbonate in response to temperature variation.

DETAILED DESCRIPTION

Figure 1:
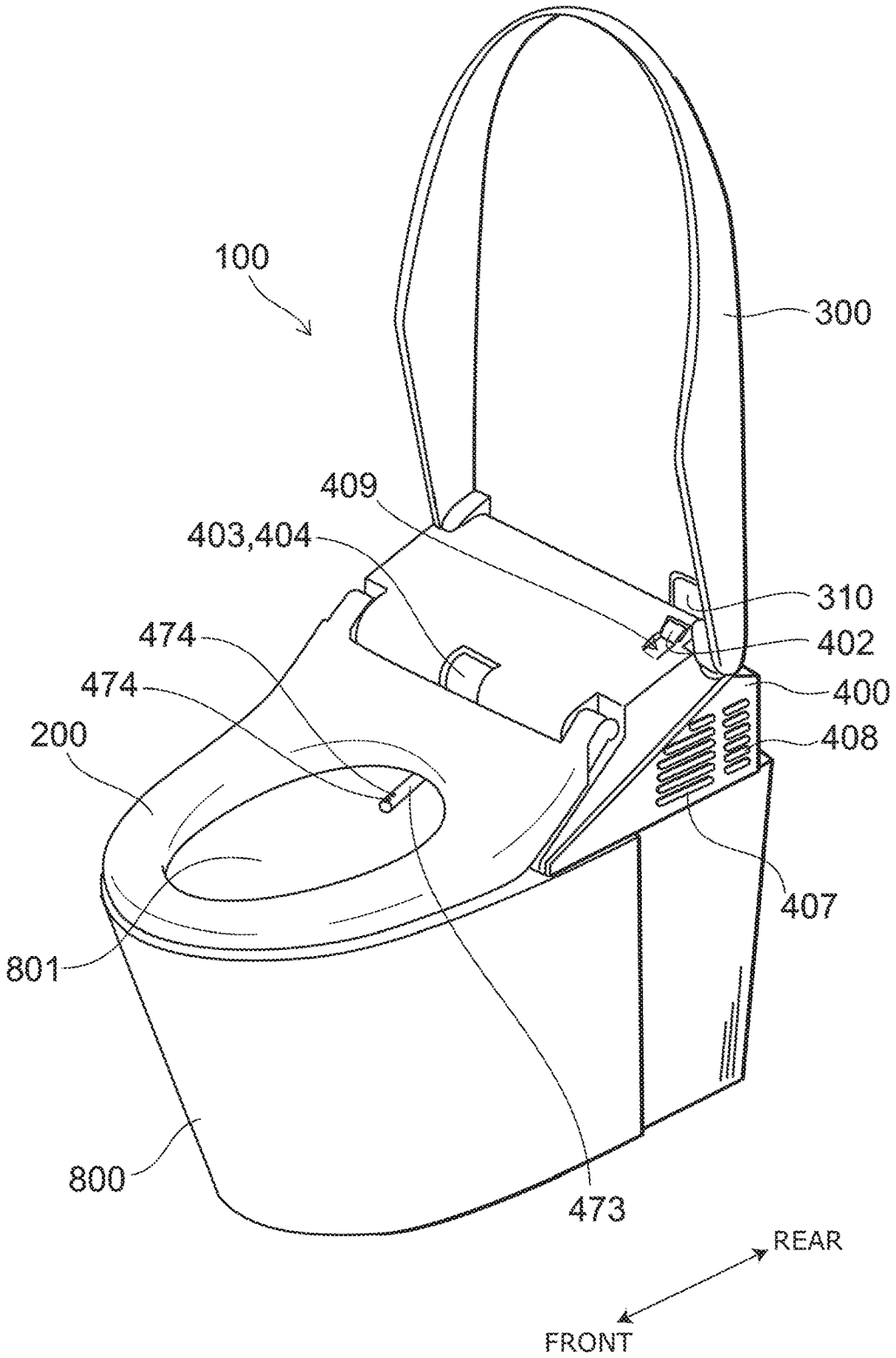
FIG. 1 is a perspective schematic view showing a toilet apparatus equipped with a sanitary washing apparatus according to an embodiment of the invention.

The first invention is a sanitary washing apparatus including: a nozzle including a jetting port and configured to squirt water from the jetting port to wash a user's body; a flow channel configured to guide water supplied from a water supply source to the jetting port; an electrolytic cell provided midway along the flow channel and being operable to produce sterilizing water; a heating device provided on the flow channel on upstream side of the electrolytic cell; a nozzle cleaning device configured to clean or sterilize the nozzle with the water heated by the heating device or the sterilizing water produced by the electrolytic cell; and a controller configured to perform control for stopping energization of the heating device or reducing an amount of energization of the heating device when energizing the electrolytic cell.

In this sanitary washing apparatus, when starting energization of the electrolytic cell and causing the electrolytic cell to produce sterilizing water to sterilize the nozzle, energization of the heating device is stopped, or the amount of energization of the heating device is reduced. Hence, when the controller starts energizing the electrolytic cell, water in the electrolytic cell is unheated water. Thus, increase of production of scale can be suppressed.

The second invention is the sanitary washing apparatus according to the first invention, wherein the amount of energization reduced is an amount of energization such that temperature of water heated by the heating device is lower than a preset value of temperature of water for washing the body.

In this sanitary washing apparatus, the controller reduces the amount of energization of the heating device to an amount of energization such that the temperature of water heated by the heating device is lower than the preset value of the temperature of hot water for body washing. Here, even when the controller has reduced the amount of energization of the heating device, if the water temperature falls below a prescribed temperature (e.g. approximately 6° C.), the controller may energize the heating device (turn on/off the heating device) to increase the water temperature in order to prevent water in e.g. the flow channel and the electrolytic cell from freezing. Also in this case, the amount of energization for antifreeze is an amount of energization such that the temperature of water heated by the heating device is lower than the preset value of the temperature of hot water for body washing. Thus, also in this case, increase of production of scale can be suppressed.

Furthermore, after the user leaves the toilet seat or the toilet room, for instance, sterilization is not performed at the temperature of water for washing the body of the next user. The controller reduces the amount of energization of the heating device to an amount of energization such that the temperature of water heated by the heating device is lower than the preset value of the temperature of hot water for body washing. Hence, the nozzle can be sterilized with sterilizing water at a temperature lower than the preset value of the temperature of water for body washing. Thus, increase of production of scale can be suppressed.

The third invention is the sanitary washing apparatus according to the first invention, wherein when energizing the electrolytic cell, if water heated by the heating device exists in the electrolytic cell, the controller starts energizing the electrolytic cell after the heated water in the electrolytic cell is replaced by unheated water.

In this sanitary washing apparatus, when energizing the electrolytic cell, if water heated by the heating device exists in the electrolytic cell, the controller starts energizing the electrolytic cell after replacing the heated water in the electrolytic cell by unheated water. Hence, when the controller starts energizing the electrolytic cell, the hot water in the electrolytic cell has been replaced by unheated water. This can further suppress electrolysis of water heated by the heating device in the electrolytic cell. Increase of production of scale can be suppressed.

The fourth invention is the sanitary washing apparatus according to the first invention, further including: a human body sensing device configured to sense utilization by the user, the controller causing the electrolytic cell to be energized and the nozzle to be sterilized with the sterilizing water after the human body sensing device comes to sense no utilization by the user.

In this sanitary washing apparatus, the controller causes the electrolytic cell to be energized and causes the nozzle to be sterilized with sterilizing water after the human body sensing device comes to sense no utilization by the user. Hence, there is no need to take utilization of body washing by the user into consideration. There is no need to retain hot water in the flow channel. Thus, the controller can cause sterilizing water to be produced in the state in which energization of the heating device is stopped.

The fifth invention is the sanitary washing apparatus according to the fourth invention, wherein the controller causes the electrolytic cell to be energized and the nozzle to be sterilized with the sterilizing water after a prescribed time after the human body sensing device comes to sense no utilization by the user.

In consideration of the case of using the sanitary washing apparatus immediately after the user leaves the toilet seat, hot water heated by the heating device may be left in the flow channel. Also in this case, in this sanitary washing apparatus, the electrolytic cell is energized and the nozzle is sterilized with sterilizing water after a prescribed time after the human body sensing device comes to sense no utilization by the user. Hence, the controller can cause the nozzle to be sterilized after the user definitely leaves the toilet seat.

The sixth invention is the sanitary washing apparatus according to the first invention, wherein the sterilizing water is water containing hypochlorous acid.

The sterilizing water produced by the electrolytic cell can include a solution containing metal ions such as silver ions or copper ions, and a solution containing e.g. electrolytic chlorine or ozone. Among them, a solution containing hypochlorous acid has stronger sterilizing power. Hence, in this sanitary washing apparatus, the nozzle can be sterilized with a solution containing hypochlorous acid, which has stronger sterilizing power.

The seventh invention is the sanitary washing apparatus according to the first invention, further including: a sterilizing water jetting nozzle provided on the flow channel on downstream side of the electrolytic cell and configured to jet the sterilizing water to a surface of a bowl of a toilet stool.

In this sanitary washing apparatus, a sterilizing water jetting nozzle for jetting sterilizing water to the surface of the bowl of the toilet stool is provided independent of the nozzle for washing the body. In general, the sanitary washing apparatus is placed and used on the toilet stool. Hence, the sanitary washing apparatus according to the invention can be effectively used as an apparatus for sterilizing bacteria present on the surface of the bowl of the toilet stool.

Embodiments of the invention will now be described with reference to the drawings. In the drawings, similar components are labeled with like reference numerals, and the detailed description thereof is omitted as appropriate.

FIG. 1 is a perspective schematic view showing a toilet apparatus equipped with a sanitary washing apparatus according to an embodiment of the invention.

Figure 2:
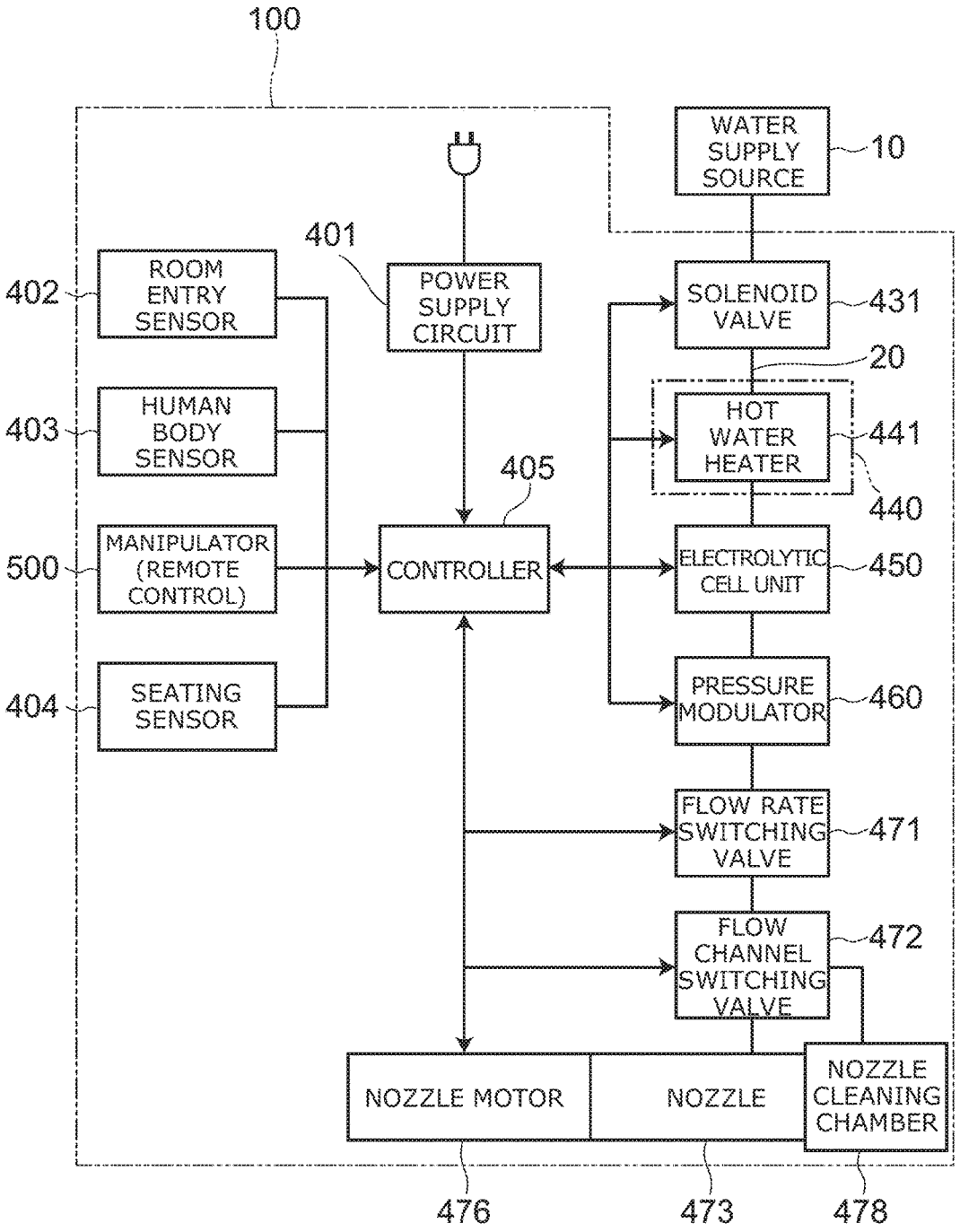
FIG. 2 is a block diagram showing the main configuration of the sanitary washing apparatus according to the embodiment.

FIG. 2 is a block diagram showing the main configuration of the sanitary washing apparatus according to the embodiment. In FIG. 2, the main configurations of the water channel system and the electrical system are shown together.

The toilet apparatus shown in FIG. 1 includes a sit-down toilet stool (hereinafter simply referred to as "toilet stool" for convenience of description) 800 and a sanitary washing apparatus 100 provided thereon. The sanitary washing apparatus 100 includes a casing 400, a toilet seat 200, and a toilet lid 300. The toilet seat 200 and the toilet lid 300 are each pivotally supported on the casing 400 in an openable/closable manner.

The casing 400 includes therein e.g. a body washing functional part for washing e.g. the "bottom" of a user seated on the toilet seat 200. Furthermore, for instance, the casing 400 includes a seating sensor (human body sensing device) 404 for sensing seating of a user on the toilet seat 200. When the seating sensor 404 is sensing a user seated on the toilet seat 200, the user can manipulate a manipulator 500 such as a remote control to advance a washing nozzle (hereinafter simply referred to as "nozzle" for convenience of description) 473 into the bowl 801 of the toilet stool 800. In the sanitary washing apparatus 100 shown in FIG. 1, the nozzle 473 is shown as being advanced into the bowl 801.

One or more jetting ports 474 are provided at the tip of the nozzle 473. The nozzle 473 can squirt water from the jetting port 474 provided at its tip to wash e.g. the "bottom" of the user seated on the toilet seat 200.

More specifically, as shown in FIG. 2, the sanitary washing apparatus 100 according to the embodiment includes a flow channel 20 for guiding water supplied from a water supply source 10 such as a water tap or a flush tank to the jetting port 474 of the nozzle 473. A solenoid valve 431 is provided on the upstream side of the flow channel 20. The solenoid valve 431 is an openable/closable solenoid valve, and regulates water supply based on commands from a controller 405 provided inside the casing 400. Here, the flow channel 20 refers to the downstream side or secondary side of the solenoid valve 431.

A heat exchanger unit (heating device) 440 is provided downstream of the solenoid valve 431. The heat exchanger unit 440 includes a hot water heater 441. The hot water heater 441 heats supplied water to hot water at a prescribed temperature. On the upstream side of the hot water heater 441 is provided an incoming water thermistor, not shown. On the downstream side of the hot water heater 441 is provided a hot water thermistor, not shown. The hot water temperature can be configured by e.g. the user manipulating the manipulator 500.

An electrolytic cell unit (electrolytic cell) 450 operable to produce sterilizing water is provided downstream of the hot water heater 441. The nozzle 473 and the flow channel 20 on the downstream side of the electrolytic cell unit 450 are sterilized with sterilizing water produced in the electrolytic cell unit 450. The electrolytic cell unit 450 is described later in detail.

A pressure modulator 460 is provided downstream of the electrolytic cell unit 450. This pressure modulator 460 provides pulsation to the flow of water in the flow channel 20. Thus, the pressure modulator 460 can provide pulsation to the water jetted from the jetting port 474 of the nozzle 473. However, in the invention, the pressure modulator 460 is not necessarily needed.

A flow rate switching valve 471 for adjusting the water force (flow rate), and a flow channel switching valve 472 for opening/closing and switching water supply to the nozzle 473 and a nozzle cleaning chamber (nozzle cleaning device) 478, are provided downstream of the pressure modulator 460. Here, the flow rate switching valve 471 and the flow channel switching valve 472 may be provided as a single unit. Furthermore, a nozzle 473 is provided downstream of the flow rate switching valve 471 and the flow channel switching valve 472.

As described above, the nozzle 473 can squirt water to wash e.g. the "bottom" of a user seated on the toilet seat 200. On the other hand, a sterilizing water jetting nozzle may be provided independent of the nozzle 473. By the sterilizing water jetting nozzle, sterilizing water produced in the electrolytic cell unit 450 is jetted from the flow channel switching valve 472 to the surface of the bowl 801 of the toilet stool 800. In this case, the sterilizing water jetting nozzle, not shown, is provided on the flow channel 20 on the downstream side of the electrolytic cell unit 450. In general, the sanitary washing apparatus 100 is placed and used on the toilet stool 800. Hence, in the case where the sterilizing water jetting nozzle for jetting sterilizing water to the surface of the bowl 801 is provided, the sanitary washing apparatus 100 can be effectively used also as an apparatus for sterilizing bacteria present on the surface of the bowl 801 of the toilet stool 800.

The nozzle 473 can be advanced into or retracted from the bowl 801 of the toilet stool 800 under a driving force from a nozzle motor 476. That is, the nozzle motor 476 can advance/retract the nozzle 473 based on commands from the controller 405.

Furthermore, the controller 405 is supplied with electrical power from a power supply circuit 401. The controller 405 can receive signals from a room entry sensor (human body sensing device) 402 for sensing entry of a user into the toilet room, a human body sensor (human body sensing device) 403 for sensing a user present in front of the toilet seat 200, a seating sensor 404 for sensing seating of a user on the toilet seat 200, and a manipulator 500. Based on these signals, the controller 405 can control the operation of the solenoid valve 431, hot water heater 441, electrolytic cell unit 450, flow rate switching valve 471 and flow channel switching valve 472, and nozzle motor 476.

The seating sensor 404 can sense a human body present above the toilet seat 200 immediately before the user is seated on the toilet seat 200. Furthermore, the seating sensor 404 can sense a user seated on the toilet seat 200. That is, the seating sensor 404 can sense not only a user seated on the toilet seat 200, but also a user present above the toilet seat 200. Such a seating sensor 404 can be e.g. an infrared transmit/receive range sensor.

The human body sensor 403 can sense a user present in front of the toilet stool 800, i.e., a user present at a position spaced in front of the toilet seat 200. That is, the human body sensor 403 can sense a user entering the toilet room and approaching the toilet seat 200. Such a human body sensor 403 can be e.g. an infrared transmit/receive range sensor.

The room entry sensor 402 can sense a user who has just opened the door of the toilet room and entered the toilet room. Furthermore, the room entry sensor 402 can sense a user about to enter the toilet room and present in front of the door. That is, the room entry sensor 402 can sense not only a user who has entered the toilet room, but also a user who is yet to enter the toilet room, i.e., a user present in front of the door outside the toilet room. Such a room entry sensor 402 can be e.g. a pyroelectric sensor, or a microwave sensor such as Doppler sensor. The microwave sensor can be based on the microwave Doppler effect, or can transmit a microwave and detect an object based on the amplitude (intensity) of the reflected microwave. In the case of using such a sensor, the presence of a user can be sensed beyond the door of the toilet room. That is, such a sensor can sense a user before entering the toilet room.

In the toilet apparatus shown in FIG. 1, a recess 409 is formed in the upper surface of the casing 400. The room entry sensor 402 is partly embedded in this recess 409. In the closed state of the toilet lid 300, the room entry sensor 402 senses entry of a user through a transmissive window 310 provided near the base of the toilet lid 300. For instance, when the room entry sensor 402 senses a user, the controller 405 can automatically open the toilet lid 300 based on the sensing result of the room entry sensor 402. Furthermore, the seating sensor 404 and the human body sensor 403 are provided at the front center of the casing 400. However, the installation configuration of the seating sensor 404, the human body sensor 403, and the room entry sensor 402 is not limited thereto, but can be suitably modified.

The casing 400 may further include various mechanisms as appropriate, such as a "warm air drying function" for blowing warm air at and drying e.g. the "bottom" of the user seated on the toilet seat 200, a "deodorizing unit", and a "room heating unit". In this case, an exhaust port 407 for exhaust from the deodorizing unit and a vent 408 for exhaust from the room heating unit are provided as appropriate on the side surface of the casing 400. However, in the invention, the sanitary washing functional part and other added functional parts are not necessarily needed.

Figure 3:
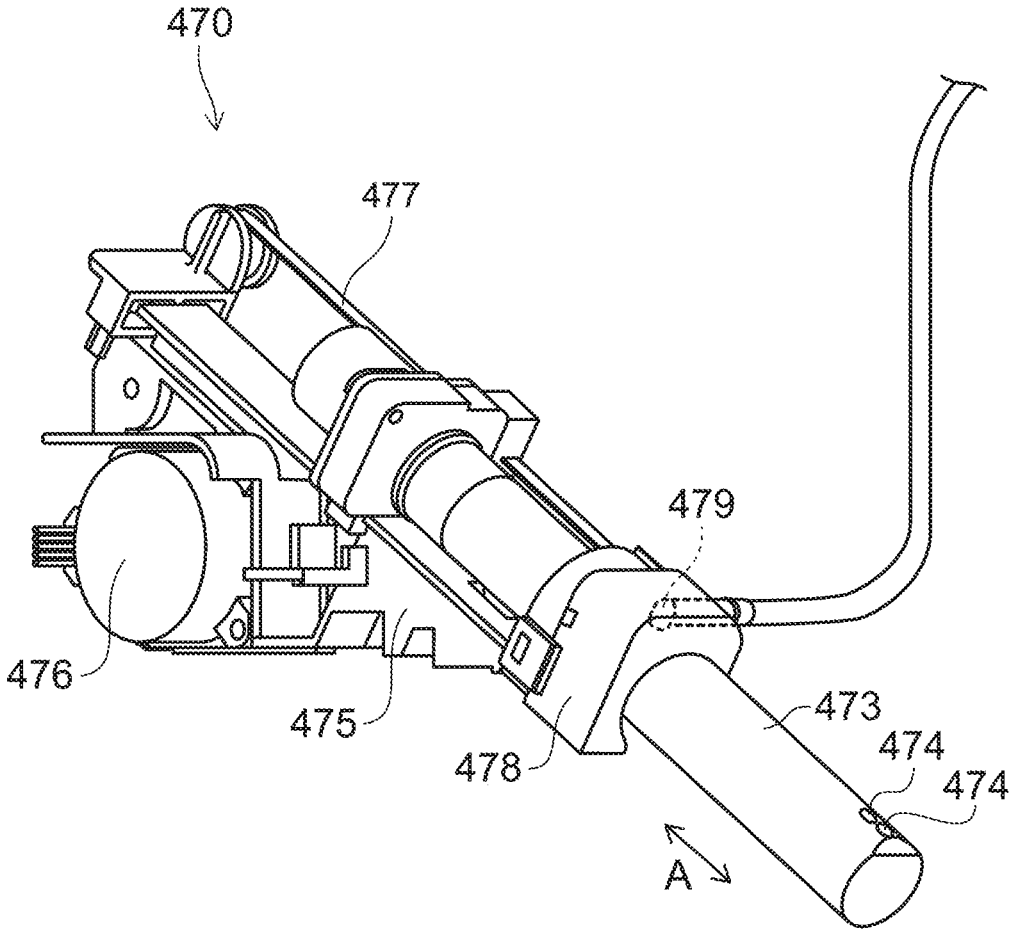
FIG. 3 is a perspective schematic view illustrating a specific example of the nozzle unit of the embodiment.

FIG. 3 is a perspective schematic view illustrating a specific example of the nozzle unit of the embodiment.

As shown in FIG. 3, the nozzle unit 470 of the embodiment includes a mounting stage 475 as a base stage, a nozzle 473 supported on the mounting stage 475, and a nozzle motor 476 for moving the nozzle 473. The nozzle 473 is provided so as to be slidable with respect to the mounting stage 475, as indicated by arrow A shown in FIG. 3, by the driving force transmitted from the nozzle motor 476 through a transmission member 477 such as a belt. That is, the nozzle 473 can linearly move in its own axial direction (advancing/retracting direction). The nozzle 473 can reciprocably move from the casing 400 and the mounting stage 475.

Furthermore, the nozzle unit 470 of the embodiment includes a nozzle cleaning chamber 478. The nozzle cleaning chamber 478 is fixed to the mounting stage 475. The nozzle cleaning chamber 478 can sterilize or clean the outer peripheral surface (trunk) of the nozzle 473 by squirting sterilizing water or water from a jetting portion 479 provided inside the nozzle cleaning chamber 478. Specifically, when the controller 405 causes the anode plate 454 (see FIG. 5) and the cathode plate 455 (see FIG. 5) of the electrolytic cell unit 450 to be energized to produce sterilizing water, the trunk of the nozzle 473 is sterilized with sterilizing water squirted from the jetting portion 479. On the other hand, when the controller 405 does not cause the anode plate 454 and the cathode plate 455 of the electrolytic cell unit 450 to be energized, the trunk of the nozzle 473 is physically cleaned with water squirted from the jetting portion 479.

More specifically, with the nozzle 473 housed in the casing 400, the region of the jetting ports 474 of the nozzle 473 is substantially housed in the nozzle cleaning chamber 478. Hence, the nozzle cleaning chamber 478 can sterilize or clean the region of the jetting ports 474 of the nozzle 473 in the housed state by squirting sterilizing water or water from the jetting portion 479 provided inside the nozzle cleaning chamber 478. Furthermore, the nozzle cleaning chamber 478 can sterilize or clean not only the region of the jetting ports 474 but also the outer peripheral surface of the other region by squirting water or sterilizing water from the jetting portion 479 when the nozzle 473 is advanced/retracted.

Furthermore, with the nozzle 473 housed in the casing 400, the nozzle 473 of the embodiment can sterilize or clean the region of the jetting ports 474 by jetting sterilizing water or water from the jetting ports 474 of the nozzle 473 themselves. Furthermore, with the nozzle 473 housed in the casing 400, the region of the jetting ports 474 of the nozzle 473 is substantially housed in the nozzle cleaning chamber 478. Hence, the sterilizing water or water jetted from the jetting port 474 of the nozzle 473 is reflected by the inner wall of the nozzle cleaning chamber 478 and splashed on the region of the jetting ports 474. Thus, the region of the jetting ports 474 of the nozzle 473 is sterilized or cleaned also with the sterilizing water or water reflected by the inner wall of the nozzle cleaning chamber 478.

Figure 4:
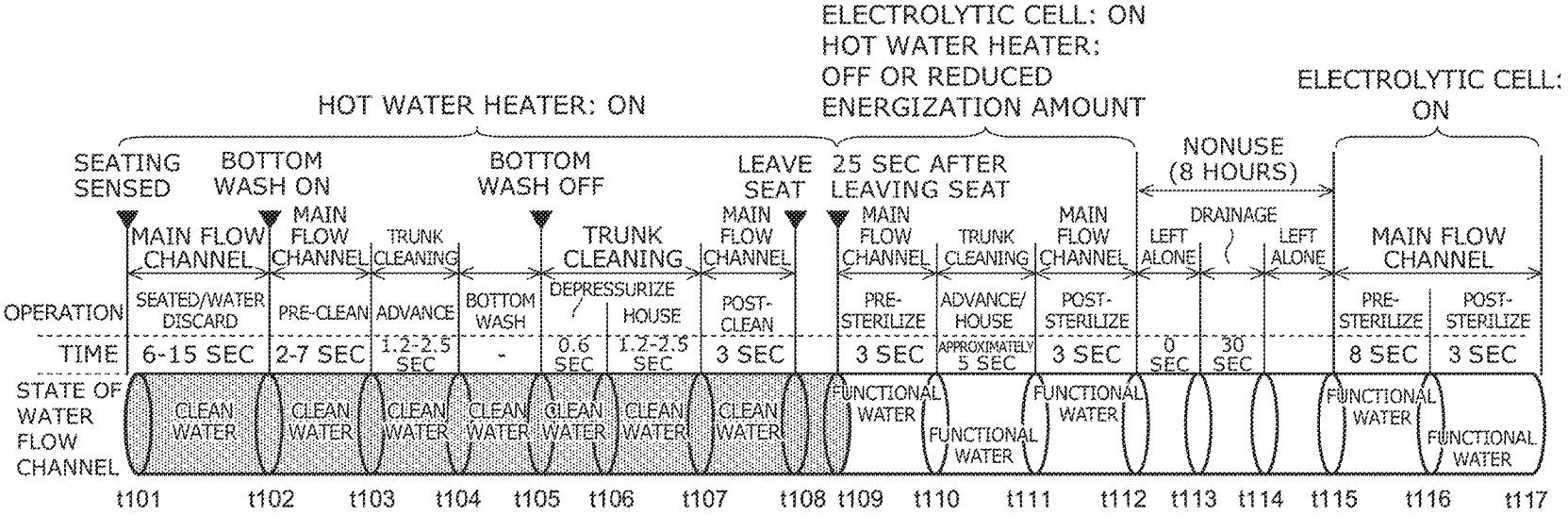
FIG. 4 is a conceptual schematic diagram generally showing the operation and the state of the flow channel of the sanitary washing apparatus according to the embodiment.

FIG. 4 is a conceptual schematic diagram generally showing the operation and the state of the flow channel of the sanitary washing apparatus according to the embodiment.

The state of the flow channel shown in FIG. 4 shows the state inside the flow channel 20 on the downstream side of the electrolytic cell unit 450.

As described later with reference to FIG. 5, under energization controlled by the controller 405, the electrolytic cell unit 450 can electrolyze tap water flowing in the gap (flow channel) between the anode plate 454 and the cathode plate 455. The water electrolyzed in the electrolytic cell unit 450 turns into a liquid containing hypochlorous acid.

Here, the sterilizing water produced in the electrolytic cell unit 450 may be a solution containing metal ions such as silver ions or copper ions. Alternatively, the sterilizing water produced in the electrolytic cell unit 450 may be a solution containing electrolytic chlorine or ozone. Alternatively, the sterilizing water produced in the electrolytic cell unit 450 may be acid water or alkaline water. Among them, a solution containing hypochlorous acid has stronger sterilizing power. In the following description, by way of example, it is assumed that the sterilizing water produced in the electrolytic cell unit 450 is a solution containing hypochlorous acid.

Hypochlorous acid functions as a sterilizing ingredient. A solution containing hypochlorous acid, i.e., sterilizing water, can efficiently remove or decompose and sterilize dirt such as resulting from ammonia. Here, the term "sterilizing water" used herein refers to a solution containing a sterilizing ingredient such as hypochlorous acid more than tap water (also simply referred to as "water").

When the electrolytic cell unit 450 electrolyzes tap water to produce a solution containing hypochlorous acid, i.e., sterilizing water, scale such as calcium carbonate ($CaCO_3$) is produced. Scale is produced when, for instance, calcium ions ($Ca^{2+}$) dissolved in water are combined with carbonate ions ($CO_3^{2-}$) produced from carbonic acid ($H_2CO_3$). If scale is produced and attached to the surface of the anode plate 454 and the cathode plate 455 of the electrolytic cell unit 450, the production efficiency of hypochlorous acid may decrease.

As a result of investigation, the inventors have found that as the temperature of water electrolyzed becomes higher, scale becomes more likely to be produced. Furthermore, as a result of investigation, the inventors have found that as the pH (hydrogen ion concentration) of water electrolyzed becomes higher, scale becomes more likely to be produced. These will be described later in detail.

Thus, in the embodiment, when energizing the electrolytic cell unit 450, the controller 405 performs control for stopping energizing the hot water heater 441 or reducing the amount of energization of the hot water heater 441. The operation of the sanitary washing apparatus 100 according to the embodiment is outlined with reference to FIG. 4.

First, when the seating sensor 404 senses a user seated on the toilet seat 200, the controller 405 opens the solenoid valve 431 and causes it to supply clean water to the flow channel 20 (timing t101). At this time, the sanitary washing apparatus 100 activates the hot water heater 441. Thus, water in the flow channel 20 is drained to the bowl 801 of the toilet stool 800 and replaced by hot water heated by the hot water heater 441. That is, the controller 405 starts hot water preparation for activating the hot water heater 441 and draining water from the jetting port 474 (timing t101). Here, the time period for performing the hot water preparation is e.g. approximately 6-15 seconds. The term "clean water" used herein refers not only to cold water, but also to heated hot water.

Next, when the user presses the "bottom washing switch", not shown, provided on the manipulator 500 (timing t102), the controller 405 receives a signal for performing body washing. Then, the controller 405 first performs "pre-cleaning" with clean water (timing t102-t103). More specifically, the controller 405 controls the flow rate switching valve 471 and the flow channel switching valve 472 so that clean water is jetted from all the plurality of jetting ports 474 to clean these jetting ports 474. At this time, the controller 405 does not cause the electrolytic cell unit 450 to be energized, and does not cause it to produce sterilizing water. Hence, the region of the plurality of jetting ports 474 is physically cleaned with clean water jetted by the jetting ports 474 themselves (including clean water reflected by the inner wall of the nozzle cleaning chamber 478). Here, the time period for performing the pre-cleaning is e.g. approximately 2-7 seconds.

Next, the controller 405 controls the flow rate switching valve 471 and the flow channel switching valve 472 so that clean water is squirted from the jetting portion 479 provided in the nozzle cleaning chamber 478. Simultaneously, the controller 405 advances the nozzle 473 into the bowl 801. Thus, the trunk of the nozzle 473 is cleaned with clean water squirted from the jetting portion 479 (timing t103-t104). At this time again, the controller 405 does not energize the electrolytic cell unit 450, and does not cause it to produce sterilizing water. Hence, the trunk of the nozzle 473 is physically cleaned with clean water squirted from the jetting portion 479. Here, the time period for advancing the nozzle 473 is e.g. approximately 1.2-2.5 seconds.

Next, the controller 405 controls the flow rate switching valve 471 and the flow channel switching valve 472 so that clean water is squirted from the jetting port 474 for "bottom washing" to wash the "bottom" of the user seated on the toilet seat 200 (timing t104-t105). At this time, the controller 405 does not energize the electrolytic cell unit 450, and does not cause it to produce sterilizing water. Hence, there is no case where sterilizing water is squirted at the user's body. Furthermore, because the hot water heater 441 is in operation, the user's body is washed with hot water heated by the hot water heater 441.

Next, when the user presses the "stop switch", not shown, on the manipulator 500 (timing t105), the controller 405 performs control for depressurization (timing t105-t106). Then, the controller 405 controls the flow rate switching valve 471 and the flow channel switching valve 472 so that clean water is squirted from the jetting portion 479 provided in the nozzle cleaning chamber 478. Simultaneously, the controller 405 houses the nozzle 473 in the casing 400 (timing t106-t107). That is, similarly to the time of advancing the nozzle, the controller 405 causes the trunk of the nozzle 473 to be physically cleaned with clean water squirted from the jetting portion 479. Here, the time period for housing the nozzle 473 is e.g. approximately 1.2-2.5 seconds.

Next, with the nozzle 473 housed in the casing 400, the controller 405 controls the flow rate switching valve 471 and the flow channel switching valve 472 so that clean water is jetted from all the plurality of jetting ports 474 to perform "post-cleaning" of these jetting ports 474 (timing t107-t108). At this time, the controller 405 does not energize the electrolytic cell unit 450, and does not cause it to produce sterilizing water. Hence, the region of the plurality of jetting ports 474 is physically cleaned with clean water jetted by the jetting ports 474 themselves (including clean water reflected by the inner wall of the nozzle cleaning chamber 478). Here, the time period for performing the post-cleaning is e.g. approximately 3 seconds.

Next, when a prescribed time (here e.g. approximately 25 seconds) has elapsed after the seating sensor 404 comes not to sense the user seated on the toilet seat 200, the controller 405 starts energizing the electrolytic cell unit 450 and causes the electrolytic cell unit 450 to produce sterilizing water (timing t109). Furthermore, the controller 405 stops energizing the hot water heater 441 or reduces the amount of energization of the hot water heater 441 (timing t109). Here, the term "reduce the amount of energization" refers to reduction to an amount of energization such that the temperature of water heated by the hot water heater 441 is lower than a preset value of the temperature of hot water for body washing. Here, the preset value of the temperature of hot water for body washing is e.g. approximately 30-40° C.

If hot water exists in the electrolytic cell unit 450 when the controller 405 starts energizing the electrolytic cell unit 450, the controller 405 opens the solenoid valve 431. Thus, the hot water in the electrolytic cell unit 450 is drained and replaced by unheated water. Then, the controller 405 starts energizing the electrolytic cell unit 450.

Furthermore, the controller 405 opens the solenoid valve 431 to supply sterilizing water to the flow channel 20 on the downstream side of the electrolytic cell unit 450 (timing t109). Thus, the flow channel 20 on the downstream side of the electrolytic cell unit 450 is sterilized with sterilizing water. Furthermore, the controller 405 controls the flow rate switching valve 471 and the flow channel switching valve 472 so that sterilizing water is jetted from all the plurality of jetting ports 474 to perform "pre-sterilization" of these jetting ports 474 (timing t109-t110). Hence, the region of the plurality of jetting ports 474 is sterilized with sterilizing water jetted by the jetting ports 474 themselves (including sterilizing water reflected by the inner wall of the nozzle cleaning chamber 478). Here, the time period for performing the pre-sterilization is e.g. approximately 3 seconds.

Next, the controller 405 controls the flow rate switching valve 471 and the flow channel switching valve 472 so that sterilizing water is squirted from the jetting portion 479 provided in the nozzle cleaning chamber 478. Simultaneously, the controller 405 advances the nozzle 473 into the bowl 801, and then houses it in the casing 400 (timing t110-t111). That is, the controller 405 performs "trunk cleaning" of the nozzle 473 with sterilizing water squirted from the jetting portion 479 (timing t110-t111). Thus, the inside of the flow channel 20 on the downstream side of the electrolytic cell unit 450 and the trunk of the nozzle 473 are sterilized with sterilizing water. Here, the time period for performing the trunk cleaning with sterilizing water is e.g. approximately 5 seconds.

Next, with the nozzle 473 housed in the casing 400, the controller 405 controls the flow rate switching valve 471 and the flow channel switching valve 472 so that sterilizing water is jetted from all the plurality of jetting ports 474 to perform "post-sterilization" of these jetting ports 474 (timing t111-t112). Hence, the region of the plurality of jetting ports 474 is sterilized with sterilizing water jetted by the jetting ports 474 themselves (including sterilizing water reflected by the inner wall of the nozzle cleaning chamber 478). Here, the time period for performing the post-sterilization is e.g. approximately 3 seconds.

Next, the controller 405 closes the solenoid valve 431, and then closes the flow channel switching valve 472, so that the sterilizing water produced in the electrolytic cell unit 450 is retained for a prescribed time inside the flow channel 20 (timing t112-t113). Thus, after the user performs "bottom washing", the inside of the flow channel 20 can be sterilized. This prescribed time is e.g. approximately 60 minutes. Thus, in the sanitary washing apparatus 100 according to the embodiment, the sterilizing water is retained for a longer time inside the flow channel 20. Hence, bacteria surviving inside the flow channel 20 can be sterilized more reliably.

Next, after the lapse of the prescribed time, the controller 405 performs "drainage" (timing t113-t114). That is, the controller 405 drains the sterilizing water inside the flow channel 20 so that the flow channel 20 is emptied. The time period for performing this "drainage" is e.g. approximately 30 seconds. Thus, in the sanitary washing apparatus 100 according to the embodiment, after the sterilizing water is retained for a prescribed time inside the flow channel 20, the sterilizing water inside the flow channel 20 is drained, and the flow channel 20 is emptied. Hence, even if the sterilizing power of the sterilizing water is decreased over time, the action of the sterilizing water as a nutrient source for bacteria can be suppressed.

Next, similarly to the operation described above with reference to timing t112-t113, the controller 405 causes the sterilizing water produced in the electrolytic cell unit 450 to be retained for a prescribed time inside the flow channel 20 (timing t114-t115).

Next, when a prescribed time (here e.g. approximately 8 hours) has elapsed after the last use of the sanitary washing apparatus 100, the controller 405 performs "pre-sterilization" and "post-sterilization" (timing t115-t116 and timing t116-t117) similarly to the operation described above with reference to timing t109-t110 and timing t111-t112.

According to the embodiment, the controller 405 stops energizing the hot water heater 441 or reduces the amount of energization of the hot water heater 441 when the controller 405 starts energizing the electrolytic cell unit 450 and causes the electrolytic cell unit 450 to produce sterilizing water to sterilize the nozzle 473. Hence, when the controller 405 starts energizing the electrolytic cell unit 450, the water in the electrolytic cell unit 450 is unheated water. Alternatively, if hot water exists in the electrolytic cell unit 450 when the controller 405 starts energizing the electrolytic cell unit 450, the controller 405 opens the solenoid valve 431. Thus, the hot water in the electrolytic cell unit 450 is drained and replaced by unheated water. Then, the controller 405 starts energizing the electrolytic cell unit 450. Hence, when the controller 405 starts energizing the electrolytic cell unit 450, the hot water in the electrolytic cell unit 450 is replaced by unheated water. Thus, increase of production of scale can be suppressed.

Even when the controller 405 has reduced the amount of energization of the hot water heater 441, if the water temperature falls below a prescribed temperature (e.g. approximately 6° C.), the controller 405 may energize the hot water heater 441 (turn on/off the hot water heater 441) to increase the water temperature in order to prevent water in e.g. the flow channel 20 and the electrolytic cell unit 450 from freezing. Also in this case, the amount of energization for antifreeze is an amount of energization such that the temperature of water heated by the hot water heater 441 is lower than the preset value of the temperature of hot water for body washing. Thus, also in this case, increase of production of scale can be suppressed. That is, the scope of the term "reduce the amount of energization" used herein encompasses the case of "energize the hot water heater 441 on the occasion of antifreeze".

Furthermore, after the user leaves the toilet seat 200 or the toilet room, for instance, sterilization is not performed at the temperature of water for washing the body of the next user. The controller 405 reduces the amount of energization of the hot water heater 441 to an amount of energization such that the temperature of water heated by the hot water heater 441 is lower than the preset value of the temperature of hot water for body washing. Hence, the nozzle 473 can be sterilized with sterilizing water at a temperature lower than the preset value of the temperature of water for body washing. Thus, increase of production of scale can be suppressed.

Furthermore, the controller 405 starts energizing the electrolytic cell unit 450 and causes the electrolytic cell unit 450 to produce sterilizing water after the seating sensor 404 comes not to sense the user seated on the toilet seat 200. Hence, there is no need to take utilization of body washing by the user into consideration. There is no need to retain hot water in the flow channel 20. Thus, the controller 405 can cause sterilizing water to be produced in the state in which energization of the hot water heater 441 is stopped.

In consideration of the case of using the sanitary washing apparatus 100 immediately after the user leaves the toilet seat 200, hot water heated by the hot water heater 441 may be left in the flow channel 20. Also in this case, in the embodiment, the controller 405 starts energizing the electrolytic cell unit 450 and causes the electrolytic cell unit 450 to produce sterilizing water after the lapse of a prescribed time after the seating sensor 404 comes not to sense the user seated on the toilet seat 200. Hence, the controller 405 can cause the nozzle 473 to be sterilized after the user definitely leaves the toilet seat 200.

In the foregoing, the operation shown in FIG. 4 is described by taking an example in which the nozzle 473 is sterilized with sterilizing water after the seating sensor 404 comes not to sense the user seated on the toilet seat 200. However, the embodiment is not limited thereto. The controller 405 may cause the nozzle 473 to be sterilized with sterilizing water after the human body sensor 403 or the room entry sensor 402 comes not to sense the user. Also in this case, the controller 405 can stop energizing the hot water heater 441 or reduce the amount of energization of the hot water heater 441, and cause the electrolytic cell unit 450 to produce sterilizing water. Thus, increase of production of scale can be suppressed.

Figure 5:
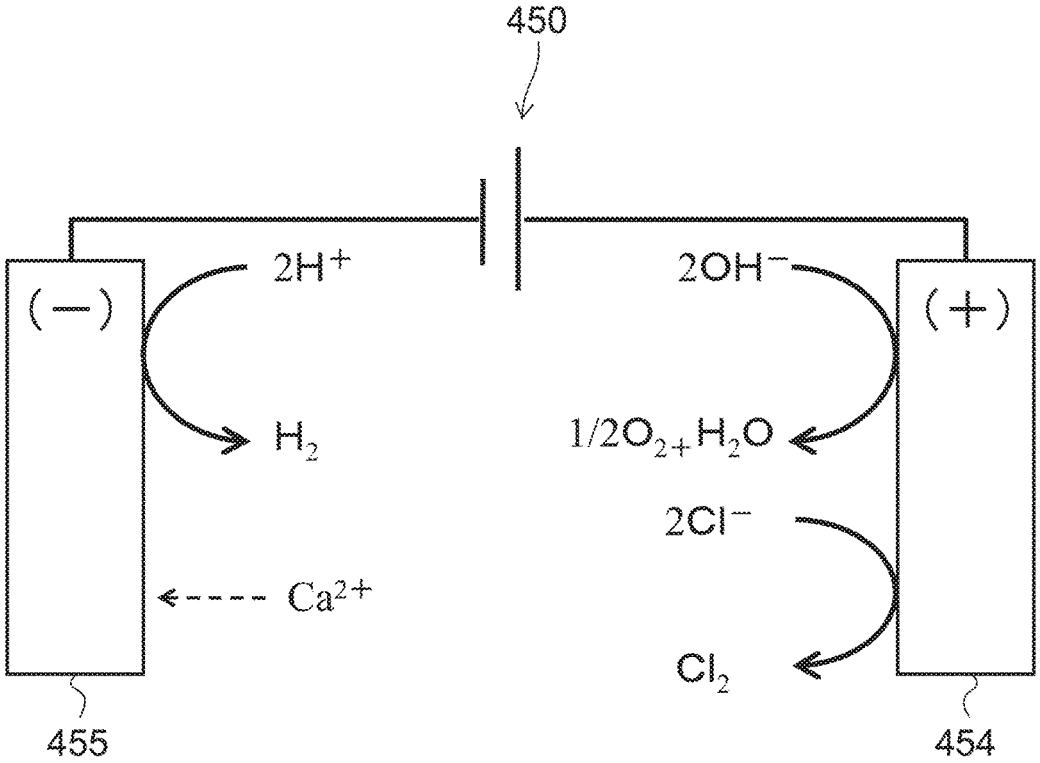
FIG. 5 is a plan schematic view for describing scale produced in the electrolytic cell unit of the embodiment.

FIG. 5 is a plan schematic view for describing scale produced in the electrolytic cell unit of the embodiment.

Figure 6:
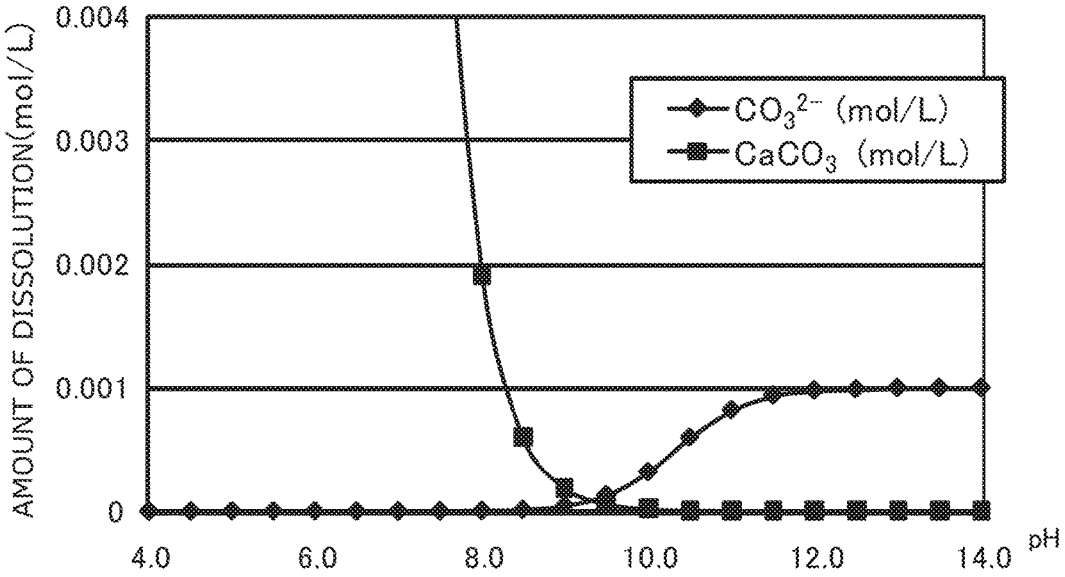
FIG. 6 is a graph showing the variation of the amount of dissolution of calcium carbonate and carbonate ions in response to the variation of pH.

FIG. 6 is a graph showing the variation of the amount of dissolution of calcium carbonate and carbonate ions in response to the variation of pH.

As shown in FIG. 5, the electrolytic cell unit 450 includes therein an anode plate 454 and a cathode plate 455. Under energization controlled by the controller 405, the electrolytic cell unit 450 can electrolyze tap water flowing in the gap (flow channel) between the anode plate 454 and the cathode plate 455. Here, at the cathode plate 455, the reaction represented by formula (1) occurs.

$$H^+ + e^- \rightarrow \frac{1}{2}H_2\uparrow \quad (1)$$

Hence, acid ($H^+$) is consumed at the cathode plate 455, and pH increases near the cathode plate 455. As shown in FIG. 6, as pH increases, the amount of dissolution of carbonate ions ($CO_3^{2-}$) increases. With the increase of pH, carbonic acid ($H_2CO_3$) releases hydrogen ions ($H^+$) to produce carbonate ions ($CO_3^{2-}$). Thus, the reaction represented by formula (2) occurs. Then, the generated carbonate ions ($CO_3^2$) are combined with calcium ions ($Ca^2$) present in tap water. Thus, the reaction represented by formula (3) occurs. That is, the increase of pH causes production (precipitation due to decreased solubility) of calcium carbonate ($CaCO_3$, i.e., scale).

$$H_2CO_3 \rightarrow 2H^+ + CO_3^{2-} \quad (2)$$

$$Ca^{2+} + CO_3^{2-} \rightarrow CaCO_3 \quad (3)$$

On the other hand, at the anode plate 454, the reaction represented by formula (4) occurs. Furthermore, the tap water contains chlorine ions ($Cl^-$). Such chlorine ions are contained as salt (NaCl) and calcium chloride ($CaCl_2$) in water sources (e.g. groundwater and water in dams and rivers). Thus, the reaction represented by formula (5) occurs.

$$2OH^- \rightarrow 2e^- + H_2O + \frac{1}{2}O_2\uparrow \quad (4)$$

$$Cl^- \rightarrow e^- + \frac{1}{2}Cl_2 \quad (5)$$

Chlorine generated in formula (5) is less likely to exist as bubbles, but mostly dissolves in water. Hence, chlorine generated in formula (5) undergoes the reaction represented by formula (6). Thus, hypochlorous acid (HClO) is produced by electrolysis of chlorine ions. Consequently, the water electrolyzed in the electrolytic cell unit 450 turns into a liquid containing hypochlorous acid. Here, alkali ($OH^-$) is consumed at the anode plate 454. Hence, pH decreases near the anode plate 454.

$$Cl_2 + H_2O \rightarrow HClO + H^+ + Cl^- \quad (6)$$

Figure 7:
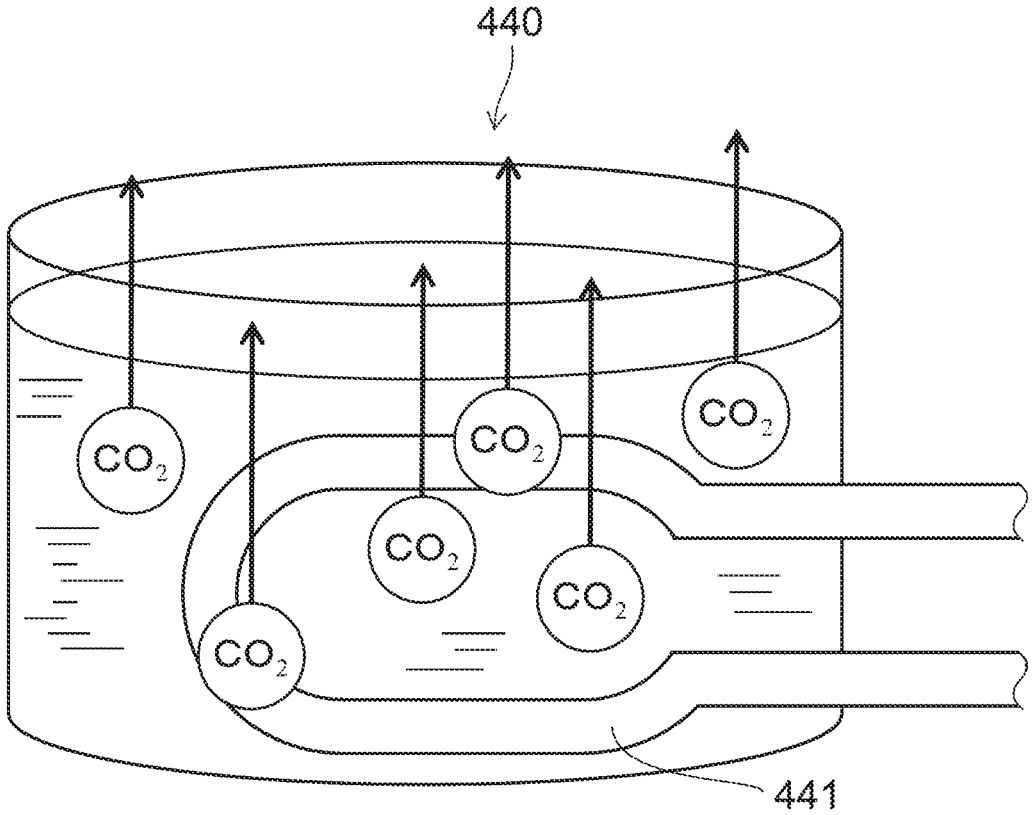
FIG. 7 is a plan schematic view for describing scale produced in the heat exchanger unit of the embodiment.

FIG. 7 is a plan schematic view for describing scale produced in the heat exchanger unit of the embodiment.

FIG. 8 is a view showing the variation of the amount of dissolution of calcium carbonate in response to temperature variation.

For instance, if the controller 405 starts energizing the electrolytic cell unit 450, the water temperature in the heat exchanger unit 440 increases. Thus, carbonic acid becomes less likely to dissolve in water, and is released as carbon dioxide ($CO_2$) into the air. Then, pH increases near the hot water heater 441. Thus, as described above with reference to FIGS. 5 and 6, scale becomes more likely to be produced. Furthermore, as shown in FIG. 8, as the water temperature increases, the amount of dissolution of calcium carbonate decreases. That is, as the water temperature increases, calcium carbonate becomes less soluble in water. Thus, as the water temperature increases, scale becomes more likely to be produced and precipitated.

This holds not only in the heat exchanger unit 440, but also in the electrolytic cell unit 450. That is, if higher temperature water is supplied to the electrolytic cell unit 450 and electrolyzed in the electrolytic cell unit 450, scale becomes more likely to be produced and precipitated.

Thus, as the water temperature increases, scale becomes more likely to be produced in the electrolytic cell unit 450 and the heat exchanger unit 440. Hence, in order to suppress the increase of production of scale and to suppress the decrease of production efficiency of hypochlorous acid, it is necessary to suppress the increase of production of scale in the electrolytic cell unit 450 and the heat exchanger unit 440.

In this context, according to the embodiment, when the controller 405 starts energizing the electrolytic cell unit 450, the controller 405 stops energizing the hot water heater 441 or reduces the amount of energization of the hot water heater 441. Hence, when sterilizing water is produced in the electrolytic cell unit 450, increase of temperature of water in the electrolytic cell unit 450 and the heat exchanger unit 440 can be suppressed. Thus, the increase of production of scale in the electrolytic cell unit 450 and the heat exchanger unit 440 can be suppressed.

Figure 9:
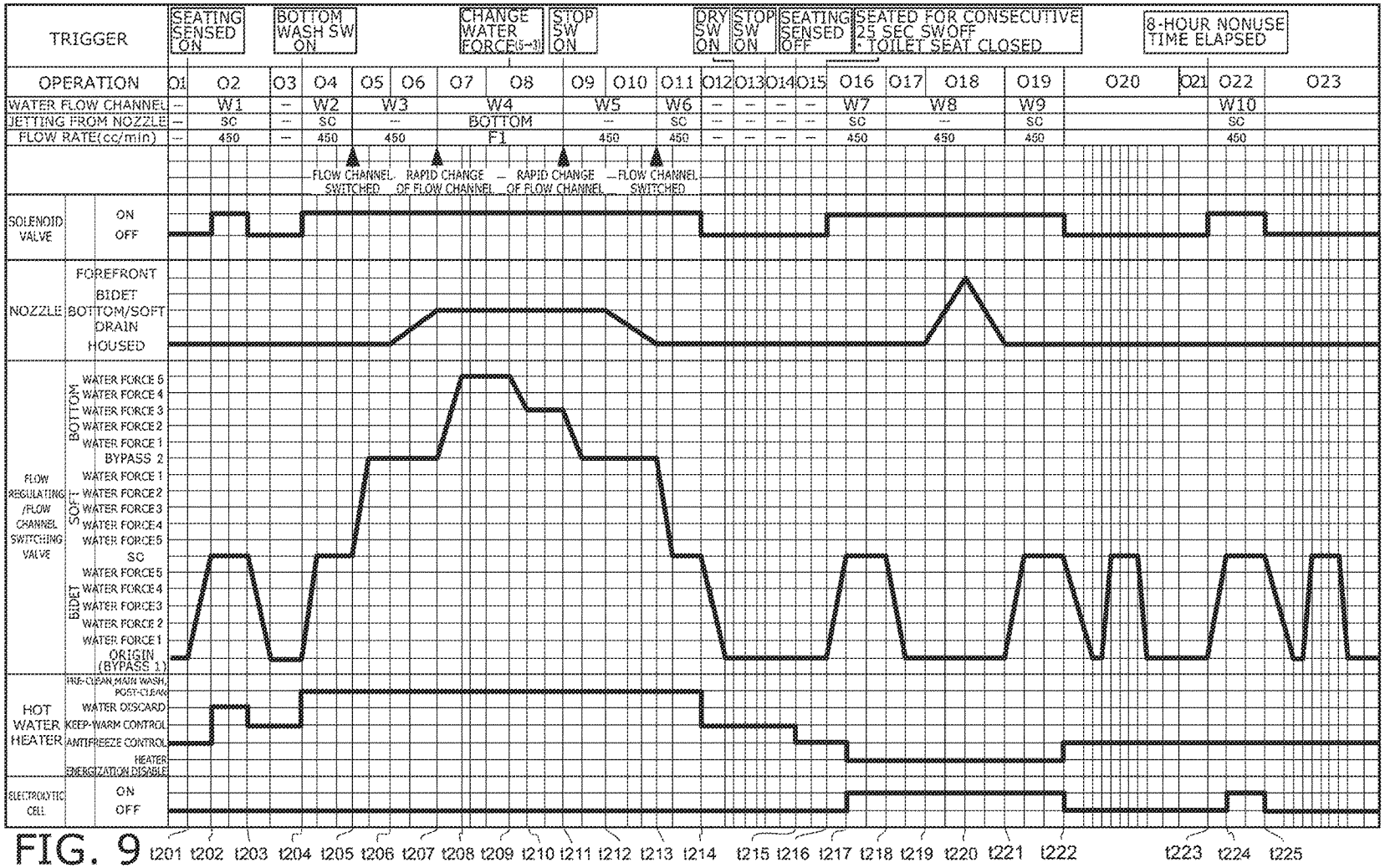
FIG. 9 is a timing chart illustrating a specific example operation of the sanitary washing apparatus according to the embodiment.

FIG. 9 is a timing chart illustrating a specific example operation of the sanitary washing apparatus according to the embodiment.

"O1" of "OPERATION" in FIG. 9 shows "STANDBY". "O2" of "OPERATION" in FIG. 9 shows "HOT WATER PREPARATION". "O3" of "OPERATION" in FIG. 9 shows "KEEP WARM". "O4" of "OPERATION" in FIG. 9 shows "PRE-CLEAN". "O5" of "OPERATION" in FIG. 9 shows "DEPRESSURE". "O6" of "OPERATION" in FIG. 9 shows "TRUNK CLEAN (ADVANCE NOZZLE)". "O7" of "OPERATION" in FIG. 9 shows "SOFT START". "O8" of "OPERATION" in FIG. 9 shows "MAIN WASH". "O9" of "OPERATION" in FIG. 9 shows "DEPRESSURE". "O10" of "OPERATION" in FIG. 9 shows "TRUNK CLEAN (HOUSE NOZZLE)". "O11" of "OPERATION" in FIG. 9 shows "POST-CLEAN". "O12" of "OPERATION" in FIG. 9 shows "KEEP WARM". "O13" of "OPERATION" in FIG. 9 shows "DRY". "O14" of "OPERATION" in FIG. 9 shows "KEEP WARM". "O15" of "OPERATION" in FIG. 9 shows "STANDBY". "O16" of "OPERATION" in FIG. 9 shows "PRE-STERILIZE". "O17" of "OPERATION" in FIG. 9 shows "DEPRESSURE". "O18" of "OPERATION" in FIG. 9 shows "TRUNK CLEAN (HOUSE NOZZLE)". "O19" of "OPERATION" in FIG. 9 shows "POST-STERILIZE". "O20" of "OPERATION" in FIG. 9 shows "DRAINAGE/HOT AIR DAMPER STUCK PREVENTION". "O21" of "OPERATION" in FIG. 9 shows "STANDBY". "O22" of "OPERATION" in FIG. 9 shows "REGULAR STERILIZATION". "O23" of "OPERATION" in FIG. 9 shows "DRAINAGE/HOT AIR DAMPER STUCK PREVENTION".

"W1" and "W2" of "WATER FLOW CHANNEL" in FIG. 9 show "MAIN CHANNEL". "W3" of "WATER FLOW CHANNEL" in FIG. 9 shows "BYPASS". "W4" of "WATER FLOW CHANNEL" in FIG. 9 shows "MAIN CHANNEL". "W5" of "WATER FLOW CHANNEL" in FIG. 9 shows "BYPASS". "W6" and "W7" of "WATER FLOW CHANNEL" in FIG. 9 show "MAIN CHANNEL". "W8" of "WATER FLOW CHANNEL" in FIG. 9 shows "BYPASS". "W9" and "W10" of "WATER FLOW CHANNEL" in FIG. 9 show "MAIN CHANNEL".

"F1" of "FLOW RATE (cc/min)" in FIG. 9 shows "FROM MINIMUM TO PRESET FLOW RATE (270-430)".

First, the seating sensor 404 senses a user seated on the toilet seat 200 (timing t201). Then, the controller 405 switches the flow rate switching valve 471 and the flow channel switching valve 472 from "origin" to "SC (self-cleaning)" and enables jetting from all the jetting ports 474 for "bottom washing" and "bidet washing". The flow rate (volume of water) at this time is e.g. approximately 450 cc/min.

Next, when the switching of the flow rate switching valve 471 and the flow channel switching valve 472 is completed (timing t202), the controller 405 opens the solenoid valve 431 and sets the hot water heater 441 to the "water discard mode". Thus, cold water in the flow channel 20 is drained to perform hot water preparation again. Next, after completing the hot water preparation, the controller 405 closes the solenoid valve 431 and switches the flow rate switching valve 471 and the flow channel switching valve 472 from "SC" to "origin (bypass 1)" (timing t203). Furthermore, the controller 405 changes the setting of the hot water heater 441 from the "water discard mode" to the "keep-warm control mode" (timing t203).

Next, when the user presses the "bottom washing switch", not shown, provided on the manipulator 500 (timing t204), the controller 405 receives a signal for performing body washing. Then, the controller 405 switches the flow rate switching valve 471 and the flow channel switching valve 472 from "origin" to "Sc". Furthermore, the controller 405 opens the solenoid valve 431 and sets the hot water heater 441 to the "pre-cleaning mode, main washing mode, post-cleaning mode".

At this time, the controller 405 does not cause the electrolytic cell unit 450 to be energized, and does not cause it to produce sterilizing water. Furthermore, the controller 405 has set the hot water heater 441 to the "pre-cleaning mode, main washing mode, post-cleaning mode" and caused it to heat water. Hence, the region of the jetting ports 474 is cleaned with hot water jetted by the jetting ports 474 themselves.

Next, the controller 405 switches the flow rate switching valve 471 and the flow channel switching valve 472 from "SC" to "bypass 2" so that water can be squirted from the jetting portion 479 provided in the nozzle cleaning chamber 478 (timing t205). Next, the controller 405 advances the nozzle 473 housed in the casing 400 to the position of "bottom washing" (timing t206-t207).

At this time, the controller 405 has opened the solenoid valve 431, does not cause the electrolytic cell unit 450 to be energized, and does not cause it to produce sterilizing water. Furthermore, the controller 405 has set the hot water heater 441 to the "pre-cleaning mode, main washing mode, post-cleaning mode" and caused it to heat water. Hence, the trunk of the nozzle 473 is cleaned with hot water squirted from the jetting portion 479.

Next, the controller 405 switches the flow rate switching valve 471 and the flow channel switching valve 472 from "bypass 2" to "bottom water force 5" (timing t207-t208) and performs main washing (bottom washing) (timing t208-t209). Here, for instance, if the user changes the setting of the water force in "bottom washing" from "water force 5" to "water force 3" by the manipulator 500, then the controller 405 switches the flow rate switching valve 471 and the flow channel switching valve 472 from "bottom water force 5" to "bottom water force 3" (timing t209-t210). Then, the controller 405 continues main washing at "water force 3" (timing t210-t211).

In this main washing, the controller 405 does not cause the electrolytic cell unit 450 to be energized, and does not cause it to produce sterilizing water. Hence, there is no case where sterilizing water is squirted at the user's body. Furthermore, the hot water heater 441 is set to the "pre-cleaning mode, main washing mode, post-cleaning mode". Hence, the user's body is washed with hot water heated by the hot water heater 441.

Next, when the user pushes a "stop switch", not shown, on the manipulator 500, the controller 405 switches the flow rate switching valve 471 and the flow channel switching valve 472 from "bottom water force 3" to "bypass 2" so that water can be squirted from the jetting portion 479 provided in the nozzle cleaning chamber 478 (timing t211). Next, the controller 405 houses the nozzle 473 advanced to the position of "bottom washing" in the casing 400 (timing t212-t213).

At this time, the controller 405 has opened the solenoid valve 431, does not cause the electrolytic cell unit 450 to be energized, and does not cause it to produce sterilizing water. Furthermore, the controller 405 has set the hot water heater 441 to the "pre-cleaning mode, main washing mode, post-cleaning mode" and caused it to heat water. Hence, the trunk of the nozzle 473 is cleaned with hot water squirted from the jetting portion 479.

Next, with the nozzle 473 housed in the casing 400, the controller 405 switches the flow rate switching valve 471 and the flow channel switching valve 472 from "bypass 2" to "SC". Thus, post-cleaning is performed by jetting water from all the jetting ports 474 for "bottom washing" and "bidet washing" (timing t213-t214).

At this time again, the controller 405 has opened the solenoid valve 431, does not cause the electrolytic cell unit 450 to be energized, and does not cause it to produce sterilizing water. Furthermore, the controller 405 has set the hot water heater 441 to the "pre-cleaning mode, main washing mode, post-cleaning mode" and caused it to heat water. Hence, the region of the jetting ports 474 of the nozzle 473 is cleaned with hot water jetted by the jetting ports 474 themselves.

Furthermore, the controller 405 closes the solenoid valve 431 and switches the flow rate switching valve 471 and the flow channel switching valve 472 from "SC" to "origin" (timing t214). Furthermore, the controller 405 changes the setting of the hot water heater 441 from the "pre-cleaning mode, main washing mode, post-cleaning mode" to the "keep-warm control mode" (timing t214).

Next, the user performs "bottom drying" as appropriate and leaves the toilet seat 200 (timing t215). Then, after the lapse of a prescribed time (here e.g. approximately 25 seconds), the controller 405 switches the flow rate switching valve 471 and the flow channel switching valve 472 from "origin" to "SC" and enables jetting from all the jetting ports 474 for "bottom washing" and "bidet washing" (timing t216). Furthermore, the controller 405 opens the solenoid valve 431 (timing t216).

Next, the controller 405 starts energizing the electrolytic cell unit 450 (timing t217). Furthermore, the controller 405 changes the setting of the hot water heater 441 from the "antifreeze mode" to the "heater energization disable mode" (timing t217). That is, the controller 405 stops energizing the hot water heater 441. Thus, "pre-sterilization" of the jetting ports 474 is performed.

Here, after opening the solenoid valve 431 (timing t216), the controller 405 starts energizing the electrolytic cell unit 450 (timing t217). Hence, even if hot water exists in the electrolytic cell unit 450, the hot water is drained and replaced by unheated water. That is, the controller 405 can start energizing the electrolytic cell unit 450 after draining the hot water in the electrolytic cell unit 450 and replacing it by unheated water. Thus, electrolysis of hot water can be suppressed, and increase of production of scale can be suppressed.

Furthermore, the controller 405 starts energizing the electrolytic cell unit 450 after opening the solenoid valve 431. This can prevent energization in the state of no water between the electrodes of the electrolytic cell unit 450. Hence, local energization of the anode plate 454 and the cathode plate 455 can be prevented. Thus, decrease of lifetime of the anode plate 454 and the cathode plate 455 can be suppressed.

Next, the controller 405 switches the flow rate switching valve 471 and the flow channel switching valve 472 from "SC" to "origin" (timing t218). Next, the controller 405 advances the nozzle 473 housed in the casing 400 to the position of "forefront" (timing t219-t220). At this time, the controller 405 has opened the solenoid valve 431 and caused the electrolytic cell unit 450 to be energized. Hence, the trunk of the nozzle 473 is sterilized with sterilizing water squirted from the jetting portion 479. Next, the controller 405 houses the nozzle 473 advanced to the position of "forefront" in the casing 400 (timing t220-t221). Also at this time, the controller 405 has opened the solenoid valve 431 and caused the electrolytic cell unit 450 to be energized. Hence, the trunk of the nozzle 473 is sterilized with sterilizing water squirted from the jetting portion 479.

Next, the controller 405 switches the flow rate switching valve 471 and the flow channel switching valve 472 from "origin" to "SC" and enables jetting from all the jetting ports 474 for "bottom washing" and "bidet washing" (timing t221). Thus, "post-sterilization" of the jetting ports 474 is performed.

Next, the controller 405 stops energizing the electrolytic cell unit 450 and changes the setting of the hot water heater 441 from the "heater energization disable mode" to the "antifreeze mode" (timing t222). Furthermore, the controller 405 closes the solenoid valve 431 and switches the flow rate switching valve 471 and the flow channel switching valve 472 from "SC" to "origin" (timing t222).

Next, when a prescribed time (here e.g. approximately 8 hours) has elapsed after the last use of the sanitary washing apparatus 100, the controller 405 switches the flow rate switching valve 471 and the flow channel switching valve 472 from "origin" to "SC" and enables jetting from all the jetting ports 474 for "bottom washing" and "bidet washing" (timing t223). Furthermore, the controller 405 opens the solenoid valve 431 (timing t223). Subsequently, the controller 405 starts energizing the electrolytic cell unit 450 (timing t224). Thus, regular sterilization in the flow channel 20 and of the jetting ports 474 is performed.

Next, the controller 405 stops energizing the electrolytic cell unit 450 (timing t225). Furthermore, the controller 405 closes the solenoid valve 431 and switches the flow rate switching valve 471 and the flow channel switching valve 472 from "SC" to "origin" (timing t225).

In this specific example, when performing "pre-sterilization", the controller 405 changes the setting of the hot water heater 441 from the "antifreeze mode" to the "heater energization disable mode" (timing t217). However, the embodiment is not limited thereto. When performing "pre-sterilization", the controller 405 may leave the hot water heater 441 set to the "antifreeze mode". That is, during timing t217-t222, the controller 405 may leave the hot water heater 441 set to the "antifreeze mode".

In this case, if the water temperature falls below a prescribed temperature (e.g. approximately 6° C.), the controller 405 energizes the hot water heater 441 (turns on/off the hot water heater 441) to increase the water temperature. Here, the amount of energization for antifreeze is an amount of energization such that the temperature of water heated by the hot water heater 441 is lower than the preset value of the temperature of hot water for body washing. Thus, also in this case, increase of production of scale can be suppressed. Here, in the region other than cold climate areas, the hot water heater 441 is virtually stopped even in the "antifreeze mode".

On the other hand, in the specific example shown in FIG. 9, when performing "pre-sterilization", the controller 405 changes the setting of the hot water heater 441 from the "antifreeze mode" to the "heater energization disable mode" (timing t217). That is, when performing "pre-sterilization", the controller 405 stops energizing the hot water heater 441. In this case, even if the water temperature falls below a prescribed temperature (e.g. approximately 6° C.), the controller 405 does not cause the hot water heater 441 to be energized. However, the solenoid valve 431 is opened, and water is passed in the flow channel 20. Hence, there is little danger of water freezing.

As described above, according to the embodiment, the controller 405 stops energizing the hot water heater 441 or reduces the amount of energization of the hot water heater 441 when the controller 405 starts energizing the electrolytic cell unit 450 and causes the electrolytic cell unit 450 to produce sterilizing water to sterilize the nozzle 473. Hence, when the controller 405 starts energizing the electrolytic cell unit 450, the water in the electrolytic cell unit 450 is unheated water. Alternatively, when the controller 405 starts energizing the electrolytic cell unit 450, the water in the electrolytic cell unit 450 is replaced by unheated water. Thus, increase of production of scale can be suppressed.

The embodiments of the invention have been described above. However, the invention is not limited to the above description. Those skilled in the art can suitably modify the above embodiments, and such modifications are also encompassed within the scope of the invention as long as they include the features of the invention. For instance, the shape, dimension, material, and layout of various components in the sanitary washing apparatus 100 and the like, and the installation configuration of the nozzle 473 and the nozzle cleaning chamber 478 are not limited to those illustrated, but can be suitably modified. Furthermore, the prescribed time after the seating sensor 404 comes not to sense the user seated on the toilet seat 200 until the controller 405 starts energizing the electrolytic cell unit 450 (approximately 25 seconds in the example described above with reference to FIGS. 4 and 9) can be suitably modified. Furthermore, the prescribed time after the last use of the sanitary washing apparatus 100 until the controller 405 performs regular sterilization (approximately 8 hours in the example described above with reference to FIGS. 4 and 9) can be suitably modified. Furthermore, it is more desirable that the jetting timing of the sterilizing water jetting nozzle for jetting sterilizing water to the surface of the bowl 801 be after cleaning the toilet stool. However, the jetting timing is not limited thereto, but can be suitably modified.

Furthermore, various components in the above embodiments can be combined with each other as long as technically feasible. Such combinations are also encompassed within the scope of the invention as long as they include the features of the invention.

What is claimed is:

1. A sanitary washing apparatus comprising:

a nozzle including a jetting port;

a heating device being operable to heat a water supplied from a water supply source;

an electrolytic cell being operable to electrolyze the water supplied through the heating device to produce sterilizing water;

a nozzle cleaning device configured to sterilize the nozzle with the sterilizing water produced by the electrolytic cell;

a flow channel switching valve configured to switch water supply from the water supply through the heating device to the nozzle and the nozzle cleaning device; and a controller configured to perform control for stopping energization of the electrolytic cell when energizing the heating device.

2. The sanitary washing apparatus according to claim 1, wherein when energizing the electrolytic cell, if water heated by the heating device exists in the electrolytic cell, the controller starts energizing the electrolytic cell after the heated water in the electrolytic cell is replaced by unheated water.

3. The sanitary washing apparatus according to claim 1, further comprising:

a human body sensing device configured to sense utilization by a user, wherein the controller causes the electrolytic cell to be energized and the nozzle to be sterilized with the sterilizing water after the human body sensing device comes to sense no utilization by the user.

4. The sanitary washing apparatus according to claim 3, wherein the controller causes the electrolytic cell to be energized and the nozzle to be sterilized with the sterilizing water after a prescribed time after the human body sensing device comes to sense no utilization by the user.

5. The sanitary washing apparatus according to claim 1, wherein the controller performs control for physically cleaning the nozzle by water without energizing the electrolytic cell when a signal to start washing of bottom of a user is input.

6. The sanitary washing apparatus according to claim 5, wherein the water which is used for physically cleaning the nozzle is a heated water heated by the heating device.

7. The sanitary washing apparatus according to claim 5, wherein the controller performs control for physically cleaning the nozzle by water without energizing the electrolytic cell when a signal to stop washing of bottom of the user is input.

8. The sanitary washing apparatus according to claim 3, wherein the human body sensing device is a seating sensor which detects seating of the user on a toilet seat.

9. The sanitary washing apparatus according to claim 3, wherein the controller performs drainage of a flow channel through which the water is passed after a prescribed time after the nozzle is sterilized by the sterilized water.

10. The sanitary washing apparatus according to claim 1, wherein the sterilizing water is water containing hypochlorous acid.

11. The sanitary washing apparatus according to claim 1, further comprising:

a sterilizing water jetting nozzle provided on the flow channel on downstream side of the electrolytic cell and configured to jet the sterilizing water to a surface of a bowl of a toilet stool.

12. A sanitary washing apparatus comprising:

a nozzle including a jetting port;

a heating device being operable to heat a water supplied from a water supply source;

an electrolytic cell being operable to electrolyze the water supplied through the heating device to produce sterilizing water;

a nozzle cleaning device configured to sterilize the nozzle with the sterilizing water produced by the electrolytic cell;

a flow channel switching valve configured to switch water supply from the water supply through the heating device to the nozzle and the nozzle cleaning device; and a controller configured to perform control for stopping energization of the heating device when energizing the electrolytic cell.

13. The sanitary washing apparatus according to claim 12, wherein when energizing the electrolytic cell, if water heated by the heating device exists in the electrolytic cell, the controller starts energizing the electrolytic cell after the heated water in the electrolytic cell is replaced by unheated water.

14. The sanitary washing apparatus according to claim 12, further comprising:

a human body sensing device configured to sense utilization by a user, wherein the controller causes the electrolytic cell to be energized and the nozzle to be sterilized with the sterilizing water after the human body sensing device comes to sense no utilization by the user.

15. The sanitary washing apparatus according to claim 14, wherein the controller causes the electrolytic cell to be energized and the nozzle to be sterilized with the sterilizing water after a prescribed time after the human body sensing device comes to sense no utilization by the user.

16. The sanitary washing apparatus according to claim 12, wherein the controller performs control for physically cleaning the nozzle by water without energizing the electrolytic cell when a signal to start washing of bottom of a user is input.

17. The sanitary washing apparatus according to claim 16, wherein the water which is used for physically cleaning the nozzle is a heated water heated by the heating device.

18. The sanitary washing apparatus according to claim 16, wherein the controller performs control for physically cleaning the nozzle by water without energizing the electrolytic cell when a signal to stop washing of bottom of the user is input.

19. The sanitary washing apparatus according to claim 14, wherein the human body sensing device is a seating sensor which detects seating of the user on a toilet seat.

20. The sanitary washing apparatus according to claim 14, wherein the controller performs drainage of a flow channel through which the water is passed after a prescribed time after the nozzle is sterilized by the sterilized water.

21. The sanitary washing apparatus according to claim 12, wherein the sterilizing water is water containing hypochlorous acid.

22. The sanitary washing apparatus according to claim 12, further comprising:

a sterilizing water jetting nozzle provided on the flow channel on downstream side of the electrolytic cell and configured to jet the sterilizing water to a surface of a bowl of a toilet stool.

23. The sanitary washing apparatus according to claim 6, wherein the controller performs control for physically cleaning the nozzle by water without energizing the electrolytic cell when a signal to stop washing of bottom of the user is input.

24. The sanitary washing apparatus according to claim 4, wherein the human body sensing device is a seating sensor which detects seating of the user on a toilet seat.

25. The sanitary washing apparatus according to claim 4, wherein the controller performs drainage of a flow channel through which the water is passed after a prescribed time after the nozzle is sterilized by the sterilized water.

26. The sanitary washing apparatus according to claim 17, wherein the controller performs control for physically cleaning the nozzle by water without energizing the electrolytic cell when a signal to stop washing of bottom of the user is input.

27. The sanitary washing apparatus according to claim 15, wherein the human body sensing device is a seating sensor which detects seating of the user on a toilet seat.

28. The sanitary washing apparatus according to claim 15, wherein the controller performs drainage of a flow channel through which the water is passed after a prescribed time after the nozzle is sterilized by the sterilized water.

* * * * *